US006789378B1

(12) United States Patent
Adams, Jr.

(10) Patent No.: US 6,789,378 B1
(45) Date of Patent: Sep. 14, 2004

(54) TRAINING DEVICE

(75) Inventor: Gary R. Adams, Jr., St. Francis, MN (US)

(73) Assignee: David Nelson, Milaca, MN (US)

( * ) Notice: Subject to any disclaimer, the term of this patent is extended or adjusted under 35 U.S.C. 154(b) by 0 days.

(21) Appl. No.: 10/409,754

(22) Filed: Apr. 9, 2003

Related U.S. Application Data

(60) Provisional application No. 60/371,760, filed on Apr. 10, 2002.

(51) Int. Cl.[7] ..... B68B 1/00
(52) U.S. Cl. ..... 54/71
(58) Field of Search ..... 54/34, 35, 57, 54/71; 119/792

(56) References Cited

U.S. PATENT DOCUMENTS

| | | | | | |
|---|---|---|---|---|---|
| 854,536 | A | * | 5/1907 | Shaver | 54/71 |
| 872,347 | A | * | 12/1907 | Howell | 54/71 |
| 2,814,923 | A | * | 12/1957 | Knauss | 54/71 |
| 3,762,631 | A | | 10/1973 | Jurkoic | 231/2.1 |
| 5,755,185 | A | | 5/1998 | Gallagher | 119/792 |

FOREIGN PATENT DOCUMENTS

| | | | | |
|---|---|---|---|---|
| GB | 2161689 A | * | 1/1986 | B68B/01/00 |

* cited by examiner

*Primary Examiner*—Robert P. Swiatek
(74) *Attorney, Agent, or Firm*—Sherrill Law Offices, PLLC; Elizabeth Lewen

(57) ABSTRACT

A device for training livestock having a barrel strap, a back strap slidably attached to the barrel strap, an extension strap releasably attached to the back strap, a headpiece slidably engaged with the extension strap, and a lead strap releasably attached to the extension strap.

9 Claims, 2 Drawing Sheets

TRAINING DEVICE

This application claims the benefit of Provisional Application Serial No. 60/371760, filed Apr. 10, 2002.

FIELD OF THE INVENTION

This invention relates to a device for training livestock.

BACKGROUND

Training of young livestock can be difficult due to livestock's natural inclination to be free and unrestrained. Horses are one type of livestock that man often desires to be trained to travel on a lead rope. Horses have a tendency to "buck" or kick their rear legs backward in an effort to resist being controlled during training. A well known control device used by horse owners and trainers is a halter or headpiece, which is a harness that fits around the horse's head and includes a means for allowing releasable attachment of a lead rope. This allows the owner or trainer to control the horse's movement to some extent by controlling the position of the horse's head. A headpiece, however, only offers a limited degree of control over the horse and does little to control bucking. A solution to this problem is offered by the training harness disclosed in U.S. Pat. No. 5,755,185 ('185). The '185 training harness comprises a halter, harness lead, neck strap, belly strap, and back strap, all of which are connected to a one-piece buck strap that extends the length of the horse, around the horse's hindquarters, and back along the opposite side of the horse. While effective for controlling bucking, the training harness disclosed in the '185 patent is difficult and time consuming to use. What is clearly needed, therefore, is an inexpensive and effective training device for livestock that is easy to use.

SUMMARY OF THE INVENTION

A first embodiment of the invention is a device comprises a headpiece, a barrel strap, a back strap, an extension strap, and a lead. The back strap is slidably engaged along its length with the barrel strap at a first contact point and a second contact point spaced along the length of the barrel strap so as to form a loop from a central portion of the back strap between the first and second contact points. A first end of the back strap is releasably attached to a first end of the extension strap. A second end of the back strap is releasably attached to a second end of the extension strap. The extension strap slidably engages the headpiece along the length of the extension strap. The lead is releasably attached to the connector point of the extension strap. The headpiece, barrel strap, back strap, and extension strap are sized, configured, and arranged such that a trainer is able to control rearward movement of the hindquarters of the animal by controlling the tension placed upon the lead when the device is fitted upon the animal with the headpiece secured over the head of the animal, the barrel strap is secured around the barrel of the animal, and the loop formed by the back strap extending around the hindquarters of the animal.

A second embodiment of the device comprises a headpiece, a barrel strap, a back strap, a first extension strap, a second extension strap, and a lead. The back strap is slidably engaged along its length with the barrel strap at a first contact point and a second contact point spaced along the length of the barrel strap so as to form a loop from a central portion of the back strap between the first and second contact points. A first end of the back strap is releasably attached to a first end of the first extension strap and a second end of the back strap is releasably attached to a first end of the second extension strap. The first and second extension straps slidably engage the headpiece along the lengths of each extension strap. The lead is releasably attached to the second end of the first extension strap and the second end of the second extension strap. The headpiece, barrel strap, back strap, first extension strap, and second extension strap are sized, configured, and arranged such that a trainer is able to control rearward movement of the hindquarters of the animal by controlling the tension placed upon the lead when the device is fitted upon the livestock with the headpiece secured over the head of the animal, the barrel strap is secured around the barrel of the animal, and the loop formed by the back strap extending around the hindquarters of the animal.

DETAILED DESCRIPTION OF THE INVENTION INCLUDING A BEST MODE

| Nomenclature | |
|---|---|
| 10 | Device |
| 20 | Headpiece |
| 30 | Barrel Strap |
| 31 | Length of Barrel Strap |
| 32 | First Contact Point |
| 33 | Second Contact Point |
| 34 | Padding for Barrel Strap |
| 40 | Back Strap |
| 41 | Length of Back Strap |
| 41a | First End of Back Strap |
| 41b | Second End of Back Strap |
| 42 | Contact Member |
| 50 | Extension Strap |
| 50x | Length of Extension Strap |
| 50a | First End of Extension Strap |
| 50b | Second End of Extension Strap |
| 50c | Connector Point |
| 51 | First Extension Strap |
| 51x | Length of First Extension Strap |
| 51a | First End of First Extension Strap |
| 51b | Second End of First Extension Strap |
| 52 | Second Extension Strap |
| 52x | Length of Second Extension Strap |
| 52a | First End of Second Extension Strap |
| 52b | Second End of Second Extension Strap |
| 60 | Lead |
| 70 | Re-attachable Attachment Means |
| 100 | Horse |

Definitions

As utilized herein, including the claims, a "headpiece" refers to an apparatus that can be attached to the head of a livestock animal and utilized to facilitate control of the animal.

As utilized herein, including the claims, the phrase "elastic material" refers to material having the ability to stretch upon the application of a stress force and return to its original length, shape, and size immediately after the removal of the stress force.

As utilized herein, including the claims, the phrase "non-elastic material" refers to material having the ability to maintain its original length, shape, and size during application of a stress force.

Construction

The device 10 can be used to train livestock to properly travel on a lead 60 or to enter a livestock trailer (not shown). Livestock refers to a quadruped mammal kept and/or raised by people and includes, but is not limited to, a horse, a mule, a donkey, cattle, a sheep, a goat, a llama, a beefalo, an ox, a bison, or a buffalo. A horse 100 is one of the more common livestock mammals trained to travel on a lead 60 or enter a livestock trailer (not shown). Therefore, the remainder of the discussion will be based upon a device 10 used upon a horse 100.

Figure 1:
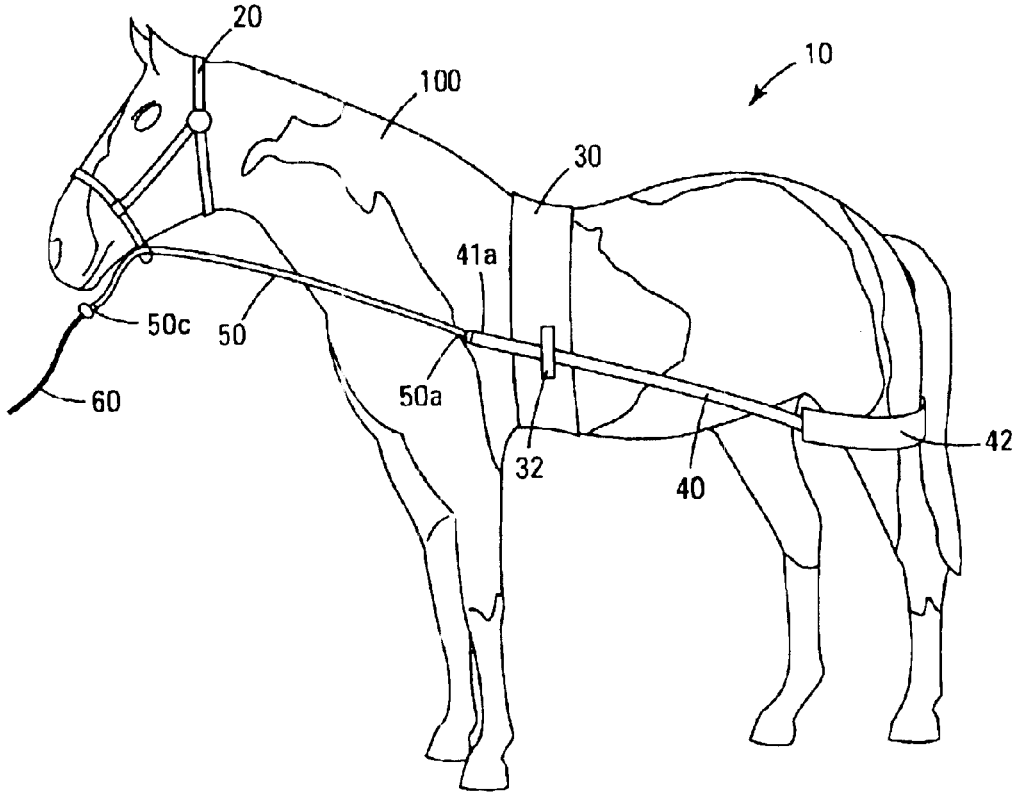
FIG. 1 is a side view of one embodiment of the device fitted upon a horse.

As shown in FIG. 1, one embodiment of the device 10 comprises a headpiece 20, a barrel strap 30, a back strap 40, an extension strap 50, and a lead 60. The headpiece 20 may be any apparatus that may be attached to the head (not numbered) of the horse 100 that allows some control over the horse 100. Preferably, a bridle, halter, or hackamore is used.

Figure 2:
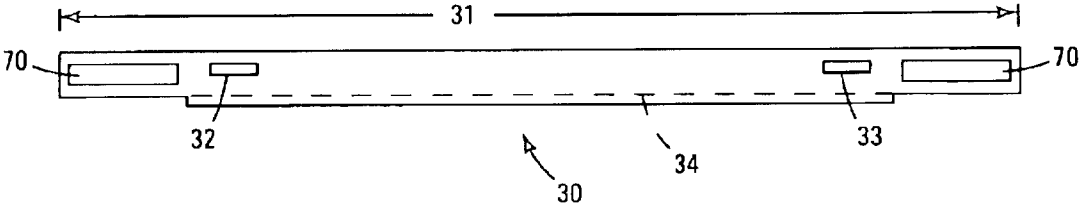
FIG. 2 is a plan view of one embodiment of a barrel strap.

The barrel strap 30 may be made from any number of suitable materials including rayon, leather, wool, cotton, and mohair, with a preference for nylon webbing. The barrel strap 30 is adjustably sized to extend around the barrel (unnumbered) of a horse 100. This is accomplished by the barrel strap 30 having re-attachable attachment means 70 allowing it to be separated so as to allow it to be fitted around the barrel of the horse 100. In a preferred embodiment, the re-attachable attachment means 70 comprises hook and loop tape such as Velcro™. Other means, such as rings and buckles may also be used. As shown in FIG. 2, at least part of the barrel strap 30 may include padding 34 to increase the comfort to the horse 100. The padding 34 may be made from any number of suitable, soft materials including foam, wool, wool blend, and cotton flannel. The barrel strap 30 has a first contact point 32 and a second contact point 33 placed along the length 31 of the barrel strap 30 such that when the barrel strap 30 is properly fitted to the horse 100, the first contact point 32 and the second contact point 33 are opposite one another on either side of the horse 100.

Figure 3:
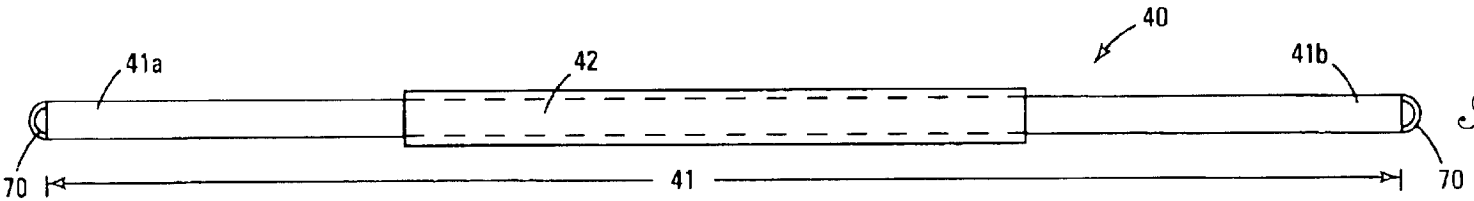
FIG. 3 is a plan view of one embodiment of a back strap.

The back strap 40 may be made from any number of suitable materials including rayon, leather, wool, cotton, and mohair, with a preference for nylon webbing. As shown in FIG. 3, a preferred embodiment of the back strap 40 has a first end 41*a*, a second end 41*b*, an optional contact member 42, and a length 41. The contact member 42 may be made from any number of suitable, soft materials including foam, wool, wool blend, and cotton flannel. The contact member 42 can be provided for the comfort of the horse 100. The back strap 40 slidably engages, along its length 41, with the barrel strap 30 at the first contact point 32 and the second contact point 33. When the back strap 40 is slidably engaged with the barrel strap 30, the back strap 40 forms a loop around the hindquarters (unnumbered) of the horse 100 in a generally perpendicular relationship to the barrel strap 30. The first end 41*a* and the second end 41*b* of the back strap 40 are releasably attached to an extension strap 50.

Figure 4:
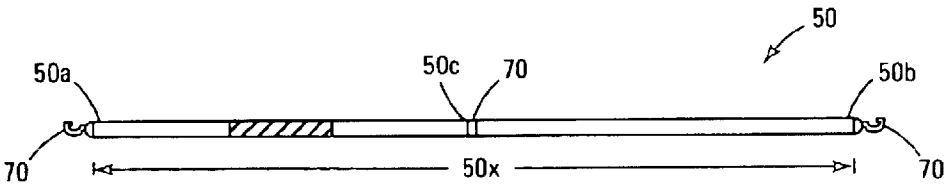
FIG. 4 is a plan view of one embodiment of an extension strap.
Figure 5:
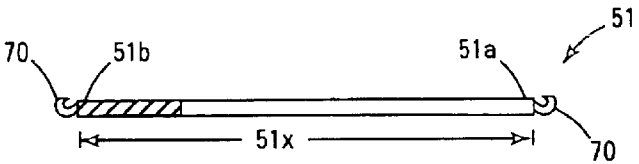
FIG. 5 is a plan view of one embodiment of a first extension strap.
Figure 6:
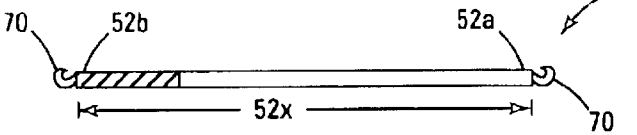
FIG. 6 is a plan view of one embodiment of a second extension strap.

One embodiment of the device 10 includes a single piece extension strap 50 such as shown in FIG. 4. Alternatively, the device 10 may include separate first and second extension straps 51 and 52 as shown in FIGS. 5 and 6.

The single piece extension strap 50 comprises a length 50*x*, a first end 50*a*, a second end 50*b*, and a connector point 50*c*. The first end 50*a* of the extension strap 50 is releasably attached to the first end 41*a* of the back strap 40. The second end 50*b* of the extension strap 50 is releasably attached to the second end 41*b* of the back strap 40. The extension strap 50 slidably engages the headpiece 20 along the length 50*x* of the extension strap 50. The connector point 50*c* of the single piece extension strap 50 releasably attaches a lead 60.

The first extension strap 51 and second extension strap 52 each comprise a length 51*x* and 52*x*, a first end 51*a* and 52*a*, and a second end 51*b* and 52*b*. The first end 51*a* of the first extension strap 51 is releasably attached to the first end 41*a* of the back strap 40. The first end 52*a* of the second extension strap 52 is releasably attached to the second end 41*b* of the back strap 40. The first extension strap 51 slidably engages the headpiece 20 along the length 51*x* of the first extension strap 51. The second end 51*b* of the first extension strap 51 releasably attaches a lead 60. The second extension strap 52 slidably engages the headpiece 20 along the length 52*x* of the second extension strap 52. The second end 52*b* of the second extension strap 52 releasably attaches a lead 60.

One of several different re-attachable attachment means 70 for releasably attaching the back strap 40 to the extension straps 50, 51, and 52 may be used such as buckles, rings, and ring and snap combinations. The preferred re-attachable attachment means 70 is a ring and snap combination (unnumbered). One of several different re-attachable attachment means 70 for releasably attaching the extension straps 50, 51, and 52 to the lead 60 may be used such as buckles, rings, and ring and snap combination. The preferred re-attachable attachment means 70 is a ring and snap combination (not shown).

The extension strap 50 may include a section of elastic material linearly attached between a first and second section of non-elastic material (not shown) with the connector point 50*c* located along the section of elastic material. When using the separate extension strap 50 embodiment, the first extension strap 51 and the second extension strap 52 may include a section of elastic material linearly attached to a section of non-elastic material. The non-elastic material sections (unnumbered) may be made from any number of suitable materials including rayon, leather, wool, cotton, and mohair, with a preference for nylon webbing. The addition of the elastic material section to the extension straps 50, 51, and 52 eases the tension and stress on the head and neck (unnumbered) of the horse 100.

Use

Use of the device 10 is generally initiated by fitting the device 10 to the horse 100. The process of fitting is greatly simplified by first detaching the extension strap 50 from the back strap 40, detaching the back strap 40 from the barrel strap 30, detaching the headpiece 20 from the extension strap 50, and detaching the lead 60 from the extension strap 50. The headpiece 20 can then be placed upon the head (unnumbered) of the horse 100 and securely attached. The barrel strap 30 can be detached, snuggly fitted around the barrel (unnumbered) of the horse 100, and then reattached. The back strap 40 may, either simultaneously with the fitting of the barrel strap 30 or following fitting of the barrel strap 30, be fitted upon the horse 100 with the first end 41*a* of the back strap 40 inserted into slidable engagement with the barrel strap 30 at the first contact point 32 and the second end 41*b* of the back strap 40 inserted into slidable engagement with the barrel strap 30 at the second contact point 33 and the back strap 40 extending around the hindquarters of the horse 100. For ease of placement of the device 10 the back strap 40 may alternatively be placed in a loop shape on the back or atop the hindquarters of the horse 100. The first end 50*a* of the extension strap 50 is releasably attached to the first end 41*a* of the back strap 40 and the second end 50*b* of the extension strap 50 is releasably attached to the second end 41*b* of the back strap 40. The extension strap 50 is slidably engaged with the headpiece 20 along the length 50*x* of the extension strap 50 with the connector point 50*c* of the extension strap 50 preferably positioned under the under the lower lip (unnumbered) of the horse 100. The central portion of the loop (unnumbered) of the back strap 40 may then be fitted around the hindquarters of the horse 100 before or after attachment of the extension strap 50 to the back strap 40. A lead 60 may be releasably attached to the connector point 50*c* of the extension strap 50.

The properly fitted device 10 allows a trainer (not shown) to control rearward movement of the hindquarters of the horse 100 by controlling the tension placed upon the lead 60.

I claim:

1. A device, comprising:

(a) a headpiece;

(b) a barrel strap having a length;

(c) a back strap having a first end, a second end, and a length with said back strap slidably engaged along the length of said back strap with said barrel strap at a first contact point and a second contact point spaced along the length of said barrel strap so as to form a loop from a central portion of said back strap between said first and said second contact points;

(d) an extension strap having a length, a first end, a second end, and a connector point intermediate of said first end and said second end wherein (1) said first end of said back strap is releasably attached to said first end of said extension strap, (2) said second end of said extension strap is releasably attached to said second end of said back strap, and (3) said extension strap slidably engages said headpiece along said length of said extension strap; and (e) a lead, wherein said lead is releasably attached to said connector point of said extension strap;

(f) wherein said headpiece, said barrel strap, said back strap, and said extension strap are sized, configured, and arranged such that a trainer is able to control rearward movement of a hindquarters of an animal by controlling the tension placed upon said lead when the device is fitted upon the animal with said headpiece secured over a head of the animal, said barrel strap secured around a barrel of the animal with said first and said second contact points located on either side of the livestock animal, and the loop formed by said back strap extending around the hindquarters of the animal.

2. A device as recited in claim 1, wherein said length of said extension strap comprises a section of an elastic material linearly attached between a first and a second section of a non-elastic material.

3. A device as recited in claim 1, wherein said connector point is a D-ring.

4. A device as recited in claim 1, wherein said back strap has a contact member located intermediate of said first end and said second end of said back strap.

5. A device as recited in claim 4, wherein said contact member has a padding material attached at a point of contact with the hindquarters of the animal.

6. A device, comprising:

(a) a headpiece;

(b) a barrel strap having a length;

(c) a back strap having a first end, a second end, and a length with said back strap slidably engaged along the length of said back strap with said barrel strap at a first contact point and a second contact point spaced along the length of said barrel strap so as to form a loop from a central portion of said back strap between said first and said second contact points;

(d) a first extension strap having a length, a first end, and a second end, wherein (1) said first end of said back strap is releasably attached to said first end of said first extension strap, and (2) said second end of said first extension strap slidably engages said headpiece along said length of said first extension strap;

(e) a second extension strap having a length, a first end, and a second end, wherein (1) said second end of said back strap is releasably attached to said first end of said second extension strap, and (2) said second end of said second extension strap slidably engages said headpiece along said length of said second extension strap; and (f) a lead, wherein said lead is releasably attached to said second end of said first extension strap and said second end of said second extension strap;

(g) wherein said headpiece, said barrel strap, said back strap, said first extension strap, and said second extension strap are sized, configured and arranged, such that a trainer is able to control rearward movement of a hindquarters of an animal by controlling the tension placed upon said lead when the device is fitted upon the animal with said headpiece secured over a head of the animal, said barrel strap secured around a barrel of the animal with said first and said second contact points located on either side of the animal, and the loop formed by said back strap extending around the hindquarters of the animal.

7. A device as recited in claim 6, wherein (1) said length of said first extension strap comprises a section of an elastic material at said second end of said first extension strap linearly attached to a section of a non-elastic material at said first end of said first extension strap, and (2) said length of said second extension strap comprises a section of an elastic material at said second end of said second extension strap linearly attached to a section of a non-elastic material at said first end of said second extension strap.

8. A device as recited in claim 6, wherein said back strap has a contact member located intermediate of said first end and said second end of said back strap.

9. A device as recited in claim 8, wherein said contact member has a padding material attached at a point of contact with the hindquarters of the animal.

* * * * *